US005889364A

United States Patent [19]

McGuigan et al.

[11] Patent Number: 5,889,364

[45] Date of Patent: Mar. 30, 1999

[54] ELECTRICAL, SOLDERLESS SNAP CONNECTOR FOR EL LAMP

[75] Inventors: Ralph McGuigan, Phoenix; Edward L. Kinnally, Gilbert, both of Ariz.

[73] Assignee: Durel Corporation, Chandler, Ariz.

[21] Appl. No.: 916,385

[22] Filed: Aug. 22, 1997

[51] Int. Cl.[6] ..... H05B 33/12

[52] U.S. Cl. ..... 313/506; 439/77; 439/78

[58] Field of Search ..... 439/81, 82, 55, 439/56, 65, 77, 78; 313/483, 498, 502, 506

[56] References Cited

U.S. PATENT DOCUMENTS

| | | | |
|---|---|---|---|
| 4,617,195 | 10/1986 | Mental | 427/66 |
| 4,626,742 | 12/1986 | Mental | 313/503 |
| 5,045,755 | 9/1991 | Appelberg | 313/498 |
| 5,055,363 | 10/1991 | Tomomura et al. | 313/506 |
| 5,073,119 | 12/1991 | Soes | 439/82 |
| 5,087,855 | 2/1992 | Overbeek et al. | 313/477 |
| 5,199,879 | 4/1993 | Kohn et al. | 439/63 |
| 5,266,865 | 11/1993 | Haizumi et al. | 313/506 |
| 5,276,382 | 1/1994 | Stocker et al. | 313/506 |
| 5,286,926 | 2/1994 | Kimura et al. | 174/250 |
| 5,332,946 | 7/1994 | Eckersley et al. | 313/506 |
| 5,384,435 | 1/1995 | Fuerst et al. | 174/262 |
| 5,497,546 | 3/1996 | Kubo et al. | 29/843 |
| 5,656,798 | 8/1997 | Kubo et al. | 174/265 |

OTHER PUBLICATIONS

Catalogue from Oxley Inc. "SMOX® Surface Mount Test Points" © 1994.

*Primary Examiner*—Sandra O'Shea
*Assistant Examiner*—Matthew J. Gerike
*Attorney, Agent, or Firm*—Paul F. Wille

[57] ABSTRACT

An EL lamp includes hole for receiving fitting attached to a printed circuit board. The fitting has a base, a head, and a neck connecting the head to the base. The diameter of the head is slightly larger than the diameter of the hole and the head fits though the hole by temporarily stretching the lamp. The lamp includes a substrate, a front electrode, a phosphor layer, and a rear electrode. The rear electrode faces the base. Contact to the front electrode is made through a first aperture in the rear electrode and in the phosphor layer. A second aperture, through the front electrode and the phosphor layer, exposes a portion of the substrate that is covered by the rear electrode. The apertures are aligned with two of the holes in the lamp.

12 Claims, 2 Drawing Sheets

ELECTRICAL, SOLDERLESS SNAP CONNECTOR FOR EL LAMP

BACKGROUND

This invention relates to electrical connectors and, in particular, to a snap connector for attaching an electroluminescent lamp to a printed circuit board.

Electroluminescent (EL) lamps are used in a variety of applications in which a lamp must be connected to a printed circuit board. (As used herein, "printed circuit board" is intended to include any substrate having one or more layers of conductive traces for interconnecting electronic devices, whether the substrate is rigid or flexible.) Portable communication devices use one or more EL lamps for backlighting displays, backlighting keypads, or for displaying information directly, e.g. as seven segment displays. Providing a low cost, reliable connection between an EL lamp and a printed circuit board has been a continuing problem.

An electroluminescent (EL) lamp is essentially a capacitor having a dielectric layer between two conductive electrodes, one of which is transparent. The dielectric layer may include a phosphor powder or there may be a separate layer of phosphor powder adjacent the dielectric layer. The phosphor powder radiates light in the presence of a strong electric field, using very little current.

The front electrode is typically a thin (≈100 nm.), transparent layer of indium tin oxide (ITO) or indium oxide on a transparent substrate of polyester or polycarbonate material having a thickness of about 7.0 mils (0.178 mm.). The rear electrode is typically screen printed using an ink containing solvent, a polymer binder such as polyvinylidene fluoride (PVDF), polyester, vinyl, or epoxy, and conductive particles such as silver or carbon.

Reliably making an electrical connection to an EL lamp is difficult because the lamp materials are relatively frail. The ITO layer is easily damaged and the rear electrode overlies the active area of the lamp. Thus, additional steps are required for reinforcing the lamp and for providing contact areas that are substantially more rugged than the lamp itself. The rear electrode must extend over a portion of the transparent substrate and be isolated from the front electrode, typically by patterning the front electrode. The tab or tail thus formed for connection makes the lamp asymmetrical and reduces the number of lamps that can be obtained from a panel of a given area.

A solder connection to an EL lamp requires a crimp fitting for receiving the solder and requires care during soldering not to melt the lamp. One could attach a thin wire to each electrode of an EL lamp but the wires would not be rugged enough for insertion into a socket. Customers for EL lamps want to assemble the lamps into products as quickly as possible, typically by using a pin and socket connection. Customers also do not want to perform any steps other than making the actual connection between a lamp and a printed circuit board.

Mechanical connectors, such as pin connectors and crimp fittings, must be secured to an EL lamp without destroying the conductor to which contact is being made. The problem is compounded by the fact that the lamp must remain relatively flat, i.e. the connector cannot distort the lamp. Unfortunately, a mechanical connection that does not distort the lamp is not likely to make a reliable electrical connection and a reliable electrical connection crimps the lamp so tightly that the lamp is no longer flat, even if the connector is separated from the luminous portion of the lamp by a short distance, e.g. 6 mm. A mechanical connector provides the advantage of physically locating a lamp in addition to making electrical connection to the lamp.

An EL lamp is essentially a two dimensional device because the thickness of a lamp is so small relative to the length and width of the lamp. Pins and other connectors add considerably to the thickness of a lamp, making the lamp more difficult to handle, package, or store. It is highly desirable to retain the advantages of a mechanical connection without changing the two dimensional nature of a lamp.

In the prior art, mechanical connections are intended to be permanent; i.e. the connection is not intended to be made and broken repeatedly. A pin and socket connector often includes a one-way type of fitting in the socket that makes removing the pin quite difficult. Other connections are mechanically secured and then soldered for reliability. Thus, a semi-permanent, reliable connection is not available in the prior art.

A pin and socket assembly that is then soldered is probably the least desirable connector from a manufacturing viewpoint. Special hardware is required for an EL lamp and for the device to be connected to the lamp, i.e. parts and pre-assembly are required. The lamp is attached in another operation and then soldered in a post-assembly operation, often followed by a cleaning step. Each step is a potential source of defect and each step has a cost associated with it. It is desired to minimize the number of steps required to manufacture a product incorporating an EL lamp.

U.S. Pat. No. 4,617,195 (Mental) discloses an EL lamp having leads extending from one side of the lamp and including front and rear electrodes patterned to avoid shorting. A pin connector is also disclosed. U.S. Pat. No. 5,045,755 (Appelberg) discloses an EL lamp having aluminum deposited on a portion of the substrate for making electrical contact to the lamp using spring contacts. U.S. Pat. No. 5,266,865 (Haizumi et al.) discloses attaching wire leads to an EL lamp and using staples or rivets for making connections to an EL lamp.

There is a fitting, known in the art as a surface mount test point, that is soldered to a printed circuit board for providing a temporary connection to a trace on the printed circuit board for testing or monitoring the operation of a circuit. The fitting includes a base and a ball connected to the base by a neck. A test lead is terminated in a suitable socket and the socket is connected to the ball to provide a rotatable, secure connection reminiscent of a trailer hitch or a grease fitting. In a commercially available test point, the ball has a diameter of 1 mm, the neck has a diameter of 0.5 mm, and the base has a diameter of 1.5 mm.

In view of the foregoing, it is therefore an object of the invention to provide a reliable, semi-permanent, electrical connection for an EL lamp.

Another object of the invention is to provide a connection that does not require special tools for attaching or removing an EL lamp.

A further object of the invention is to provide a snap-in connection for an EL lamp in which the lamp itself is part of the connector.

Another object of the invention is to provide an electrical connection that can be located anywhere in an EL lamp.

A further object of the invention is to provide a connection that requires no additional hardware attached to an EL lamp.

Another object of the invention is to provide an electrical connection for an EL lamp that lends itself to automated assembly.

A further object of the invention is to provide an electrical connection for an EL lamp that requires no post-assembly operations.

Another object of the invention is to provide an electrical connection for an EL lamp that also secures the lamp in a fixed position.

SUMMARY OF THE INVENTION

The foregoing objects are achieved by this invention in which an EL lamp includes at least one hole for receiving a fitting attached to a printed circuit board. The fitting has a base, a head, and a neck connecting the head to the base. The diameter of the head is slightly larger than the diameter of the hole and the head fits though the hole by temporarily stretching the lamp. The lamp includes a substrate, a front electrode, a phosphor layer, and a rear electrode. The rear electrode faces the base. Contact to the front electrode is made through a first aperture in the rear electrode and in the phosphor layer. A second aperture, through the front electrode and the phosphor layer, exposes a portion of the substrate that is covered by the rear electrode. The apertures are aligned with holes in the lamp.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
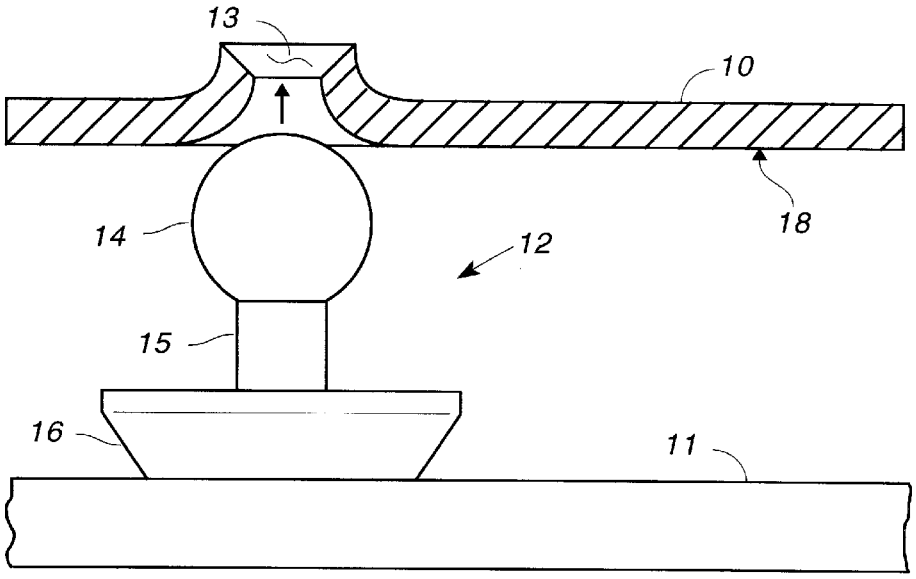
FIG. 1 illustrates a connection being made to an EL lamp in accordance with the invention.

In FIG. 1, EL Lamp 10 is positioned above printed circuit board 11 and fitting 12 is aligned with hole 13 in the EL Lamp. Fitting 12 includes head 14 connected to base 16 by neck 15. As illustrated in FIG. 1, head 14 is spherical and is separated from base 16 by less than the diameter of the head. The diameter of head 14 is larger than the diameter of hole 13. As head 14 is inserted through EL Lamp 10, hole 13 stretches temporarily to permit the head to pass through the hole. Head 14 passes through EL Lamp 10 from the rear to the front; that is, lower surface 18 of EL Lamp 10 is the rear electrode of the lamp and the lamp emits light upwardly, as oriented in FIG. 1.

Figure 2:
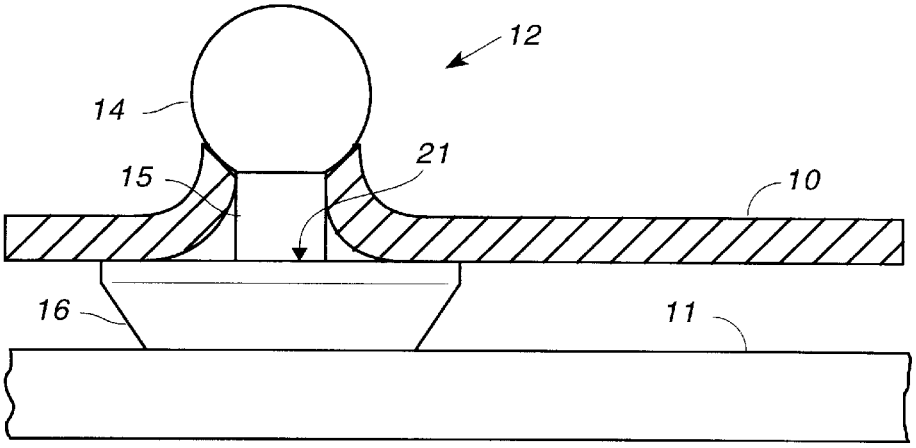
FIG. 2 illustrates an EL lamp being held in place by a connector constructed in accordance with the invention.

FIG. 2 illustrates lamp 10 attached to printed circuit board 11. Lamp 10 is slightly deformed around neck 15 with the neck filling hole 13. Depending upon the relative diameters of head 14 and hole 13, a portion of lamp 10 may curve upwardly, as illustrated, or lie flat. In either event, lamp 10 is securely held to fitting 12, which is soldered to printed circuit board 11. In informal tests of lamps constructed in accordance with the invention, several ounces of force was necessary to remove a lamp attached to a printed circuit board in accordance with the invention. That is, the force that had to be applied to the lamp exceeded the weight of the lamp by more than an order of magnitude.

Modern (post-1980) EL lamps are made by depositing layers on a transparent substrate. Thus, the two conductive electrodes of interest are located on the lower surface of lamp 10 but the front electrode is not directly accessible. Nevertheless, as explained in connection with FIG. 2, upper surface 21 of base 16 makes contact with an electrode of lamp 10.

Figure 3:
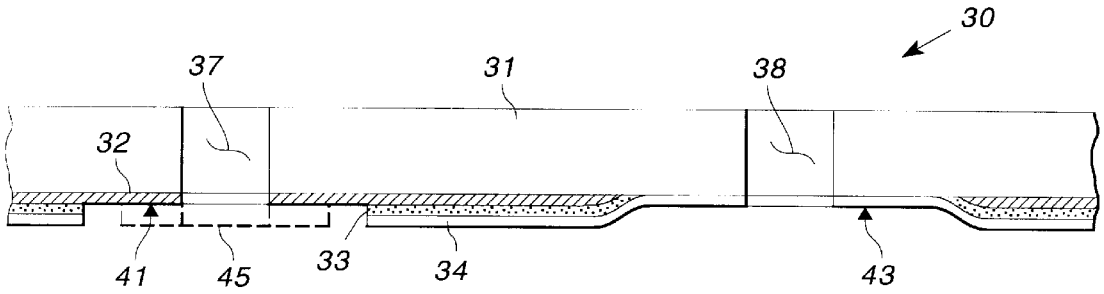
FIG. 3 is a cross-section of an EL lamp constructed in accordance with the invention.

FIG. 3 is a cross-section of an EL Lamp constructed in accordance with the invention for making contact to both the front electrode and the rear electrode. EL lamp 30 includes substrate 31, front electrode 32, phosphor layer 33, and rear electrode 34. In addition, holes 37 and 38 are formed in substrate 31 for receiving a fitting in accordance with the invention.

Around hole 37, portion 41 of front electrode 32 is exposed. In a conventional EL lamp, phosphor layer 33 and rear electrode 34 are typically deposited by screen printing. In accordance with the invention, phosphor layer 33 and rear electrode 34 are not deposited in the vicinity of hole 37, leaving an aperture exposing portion 41 of front electrode 32. The front electrode is relatively thin and conductive layer 45 is optionally screen printed about hole 37 to provide a more rugged layer for making a connection. Layer 45 is preferably of the same material and is printed at the same time as rear electrode 34.

Around hole 38, a portion of front electrode 32 has been removed and the portion covered by rear electrode 34 such that portion 43 of the rear electrode is in direct contact with substrate 31. A fitting inserted through hole 37 makes contact with front electrode 32 and a fitting inserted through hole 38 makes contact with rear electrode 34.

Figure 4:
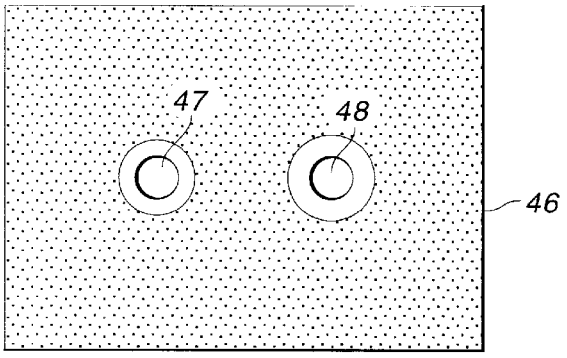
FIG. 4 is a plan view of an EL lamp constructed in accordance with the invention.
Figure 5:
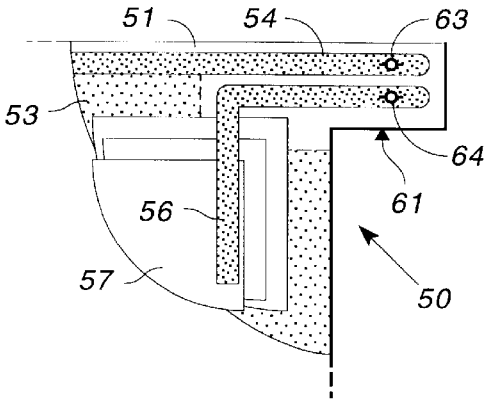
FIG. 5 is a plan view of a portion of an EL lamp constructed in accordance with another aspect of the invention.

As illustrated in FIGS. 4 and 5, the holes for receiving a fitting can be located anywhere in a lamp. In FIG. 4, lamp 46 includes holes 47 and 48 located near the center of the lamp. Hole 47 is surrounded by an exposed portion of the front electrode and corresponds to hole 37 in FIG. 3. Hole 48 is surrounded by an exposed portion of the rear electrode and corresponds to hole 38 in FIG. 3.

A lamp can be divided into a number of segments and the number of holes in a lamp depends upon the number of segments that one desires to control separately. Thus, for example, a lamp including three lamps may have two, three, or four holes depending upon how the individual segments are to be controlled.

FIG. 5 illustrates a lamp in which the contacts for the front and rear electrodes are provided on a tab at one corner of the lamp. Lamp 50 includes transparent substrate 51 having transparent, front electrode 53 overlying substantially all the transparent substrate except for the corner illustrated in FIG. 5. Bus bar 54, which may include a stripe of conductive ink, extends along one edge of front electrode 53 and across transparent substrate 51 to tab 61. Bus bar 56 overlies rear electrode 57 and extends to tab 61. At tab 61, hole 63 is located in bus bar 54 and hole 64 is located in bus bar 56. The length of tab 61 depends upon the particular application and the size of holes 63 and 64 depends upon the size of the fittings used and the width of the bus bars. Thus, for lamps that must be substantially entirely lit, a tab can be provided for electrical connection to the lamp.

Figure 6:
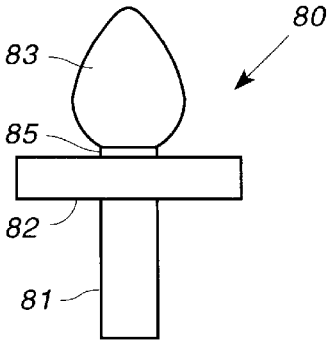
FIG. 6 illustrates a fitting constructed in accordance with an alternative embodiment of the invention.
Figure 7:
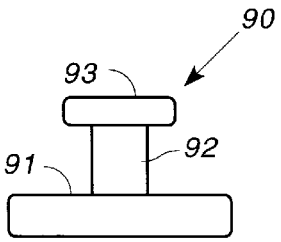
FIG. 7 illustrates a fitting constructed in accordance with an alternative embodiment of the invention.
Figure 8:
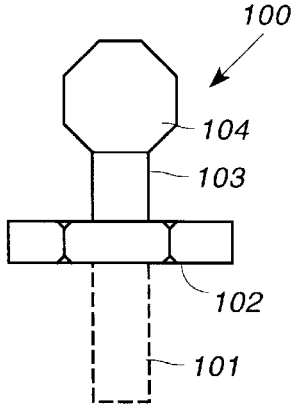
FIG. 8 illustrates a fitting constructed in accordance with an alternative embodiment of the invention.

FIGS. 6, 7, and 8 illustrate alternative embodiments of a fitting. In FIG. 6, fitting 80 includes stem 81, base 82, tapered head 83, and neck 85. Stem 81 is for insertion into a hole in the printed circuit board to increase the contact area with the printed circuit board and to provide a more secure connection than obtainable from a surface mount device. Head 83 is tapered to facilitate insertion through a hole in an EL lamp and to facilitate locating the hole. Neck 85, as illustrated in FIG. 6, is relatively short and may be eliminated, depending upon the radius of curvature of head 33 and the thickness of the lamp to be connected. For example, if a lamp is relatively thin, then neck 85 can be eliminated.

FIG. 7 illustrates a surface mount device constructed in accordance with the invention in which fitting 90 includes base 91, neck 92 and head 93. Head 93 is preferably a disc, which does not require that the hole in a lamp stretch about the full diameter of head 93 as in the case of a spherical head. In order to fit around head 93, a hole in an EL lamp need only elongate in one direction to exceed the diameter of head 93, rather than stretch equally in all directions as when the head is round.

FIG. 8 illustrates an alternative embodiment of the invention wherein fitting 100 is faceted. Fitting 100 includes optional stem 101, base 102, neck 103 and head 104. As illustrated in FIG. 8, base 102 and head 104 are faceted, which may be preferable in certain applications to facilitate automatic loading and handling of the fittings.

Figure 9:
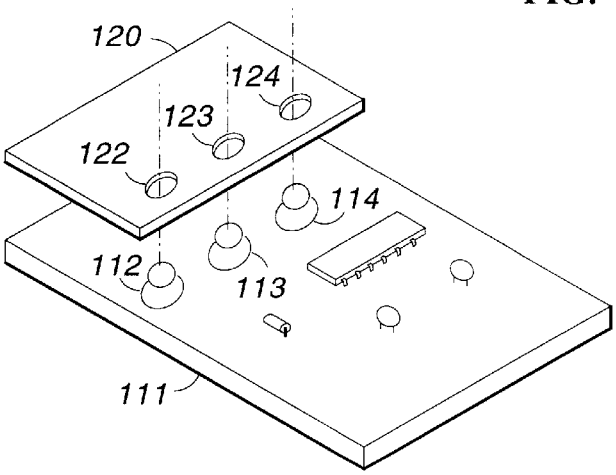
FIG. 9 illustrates a printed circuit and an EL lamp from a portable electronic device constructed in accordance with an alternative embodiment of the invention.

FIG. 9 illustrates the connection of a printed circuit board and an EL lamp in accordance with the invention. A personal electronic device includes one or more printed circuit boards, such as board 111. Connected near one end of board 111 are fittings 112, 113, and 114. Positioned slightly above board 111 is EL lamp 120 having holes 122, 123, and 124 aligned with the fittings on the board. EL lamp 120 is attached simply by pressing the lamp downwardly onto the printed circuit board. In an automated assembly operation, a suitable tool (not shown) having holes aligned with holes 122, 123, and 124, is pressed down over EL lamp 120 to secure the lamp to board 111. If EL lamp 120 should be damaged or defective, the lamp is easily replaced by lifting the lamp from board 111 to separate the fittings from the holes.

The invention thus provides a snap connector for an EL lamp that does not require hardware to be added to the lamp for making a mechanical connection or an electrical connection. The connector is suited to automatic assembly and no post-assembly operations such as soldering, attaching screws, or cleaning are required. Further, the invention avoids heat damage to an EL lamp from soldering or other high temperature operations. An EL lamp is easily attached or replaced without any special tools. The connections can be located anywhere in the lamp and the connection sites are relatively small, thereby saving money and increasing product versatility. A lamp constructed in accordance with the invention remains essentially a two dimensional device.

Having thus described the invention, it will be apparent to those of skill in the art that various modifications can be made within the scope of the invention. For example, although a surface mount test point has been described as suitable for use in the invention, these devices are precision made to assure low contact resistance and to have other qualities that are not critical for the invention. The holes could include slots or be slots but this would not position a lamp as accurately as a hole of circular cross-section because of the assymetry of a slot. A spring connector, similar in appearance to a miniature pantograph pickup, could be used instead of solid head.

What is claimed as the invention is:

1. A snap connector for an electroluminescent lamp, the connector comprising:

a hole in said lamp, said hole having a first diameter; and a fitting for attachment to a printed circuit board, said fitting including a base, a head, and a neck connecting the head to the base, wherein the head has a second diameter and said second diameter is larger than said first diameter;

wherein said head fits though said hole by temporarily stretching said lamp and wherein said lamp is held in place between said head and said base.

2. The snap connector as set forth in claim 1 wherein said lamp includes a substrate, a front electrode on said substrate, a phosphor layer on said front electrode, and a rear electrode on said phosphor layer;

wherein said rear electrode faces said base.

3. The snap connector as set forth in claim 2 wherein said lamp further includes:

a second hole in said lamp;

an aperture in said rear electrode and in said phosphor layer, said aperture being larger than said second hole and aligned with said second hole to provide access to said front electrode; and a second fitting located in said second hole for making electrical contact to said front electrode.

4. The snap connector as set forth in claim 2 and further including a conductive layer coupling said front electrode to said fitting.

5. The snap connector as set forth in claim 2 and further including a conductive layer coupling said rear electrode to said fitting.

6. The snap connector as set forth in claim 2 wherein said lamp includes a tab and a conductive trace extending along said tab, wherein said hole is located in said trace on said tab.

7. The snap connector as set forth in claim 6 wherein said trace is coupled to said front electrode.

8. The snap connector as set forth in claim 6 wherein said trace is coupled to said rear electrode.

9. An electroluminescent lamp having at least two holes for engaging a pair of fittings for making electrical connection to the lamp, said lamp comprising:

a transparent substrate;

a transparent front electrode overlying said substrate;

an electroluminescent layer overlying said front electrode;

a rear electrode overlying said electroluminescent layer;

a first hole extending through said lamp, wherein said first hole is surrounded by an exposed portion of said front electrode;

a second hole extending through said lamp, wherein said second hole is surrounded by an exposed portion of said rear electrode.

10. The lamp as set forth in claim 9 and further including a conductive layer overlying said exposed portion of said front electrode for electrically connecting said exposed portion with one of said fittings.

11. The lamp as set forth in claim 9 wherein said front electrode and said electroluminescent layer each have an aperture that is concentric with said second hole and larger than said second hole and wherein said portion of said rear electrode overlies said transparent substrate.

12. The lamp as set forth in claim 9 wherein said lamp includes at least one slit extending from each hole for facilitating engagement with said fittings.

* * * * *